United States Patent [19]

Mikoshiba

[11] 4,373,439

[45] Feb. 15, 1983

[54] CHARACTER RING-SELECTING TYPE PRINTER

[75] Inventor: Hitoshi Mikoshiba, Shiojiri, Japan

[73] Assignees: Shinshu Seiki Kabushiki Kaisha, Nagano; Kabushki Kaisha Suwa Seikosha, Tokyo, both of Japan

[21] Appl. No.: 216,900

[22] Filed: Dec. 16, 1980

[30] Foreign Application Priority Data

Dec. 17, 1979 [JP] Japan ..... 54-163692

[51] Int. Cl.[3] ..... B41J 9/12

[52] U.S. Cl. ..... 101/93.09; 101/93.16; 101/93.22; 101/99

[58] Field of Search ..... 101/99 X, 93.09 I, 110, 101/93.16, 93.22, 93

[56] References Cited

U.S. PATENT DOCUMENTS

| | | | |
|---|---|---|---|
| 3,850,097 | 11/1974 | Sweeney | 101/93.09 |
| 4,033,256 | 7/1977 | Hanaoka | 101/99 |
| 4,230,039 | 10/1980 | Mizutani et al. | 101/93.09 X |
| 4,250,807 | 2/1981 | Kondo et al. | 101/93.09 |

FOREIGN PATENT DOCUMENTS 2830226 2/1979 Fed. Rep. of Germany ... 101/93.09

OTHER PUBLICATIONS

"Print Hammer Arrangement", Heydkamp et al, *IBM Technical Disclosure Bulletin,* vol. 9, No. 8, 1/1967, pp. 1013-1014.

*Primary Examiner*—Edgar S. Burr
*Assistant Examiner*—Moshe I. Cohen
*Attorney, Agent, or Firm*—Blum, Kaplan, Friedman, Silberman and Beran

[57] ABSTRACT

Character rings mounted on a common shaft and having a plurality of circumferential character columns thereon, are opposed by a platen including recessed portions. A recessed portion faces non-printing character columns when the platen presses against one character column on each character ring for printing on paper. The platen translates laterally so that each character column on a character ring is printed in sequence. A single character selection and return mechanism serves all columns on a single character ring. A translating mask separates non-printing characters from the paper.

9 Claims, 6 Drawing Figures

CHARACTER RING-SELECTING TYPE PRINTER

BACKGROUND OF THE INVENTION

This invention relates generally to a character ring selecting type printer of the type used in miniaturized printers, and more particularly, to a character ring selecting type printer where a single character selection and return mechanism serves a plurality of columns for printing. Printers of the prior art used in small desk calculators and the like have been complex, costly to fabricate and unreliable in performance. When the structure has been simplified, for example, by using a plurality of character columns on a single drum, the structure has become larger than is desirable for such applications.

What is needed is a character ring selecting type printer which eliminates much of the complexity and unreliability and remains compact in arrangement.

SUMMARY OF THE INVENTION

Generally speaking, in accordance with the invention, a character ring selecting type printer especially suitable for small calculators is provided. Character rings mounted on a common shaft and having a plurality of circumferential character columns thereon, are opposed by a platen including recessed portions. A recessed portion faces all non-printing character columns when the platen presses against one character column on each character ring for printing on paper. Thus, a plurality of spaced characters are printed simultaneously. The platen translates laterally so that each character column on a character ring is printed in sequence to fill in the spaces between the previously printed characters. A single character selection and return mechanism associates with each character ring and serves in printing all columns on that ring. A translating mask separates non-printing characters from the paper while characters are printed, thereby, staining of the paper is avoided.

Accordingly, it is an object of this invention to provide an improved character ring selecting type printer which improves reliability by increasing the lateral space between character rings and reduces the number of character selecting mechanisms.

Another object of this invention is to provide an improved character ring selecting type printer which prints a plurality of character columns from a single character ring.

A further object of this invention is to provide an improved character ring selecting type printer wherein a platen translates laterally to print individually a plurality of adjacent characters on the same character ring.

Still another object of this invention is to provide an improved character ring selecting type printer which prevents staining of the paper in areas where printing is not occurring.

Still other objects and advantages of the invention will in part be obvious and will in part be apparent from the specification.

The invention accordingly comprises the features of construction, combination of elements, and arrangement of parts which will be exemplified in the construction herein after set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

In the printer, in accordance with this invention, the number of character rings and the number of character ring selecting mechanisms are less than the total number of character columns. The characters in a line of printed characters are printed by translating a platen laterally, transversely to the columns, by means of a translating mechanism.

Figure 1:
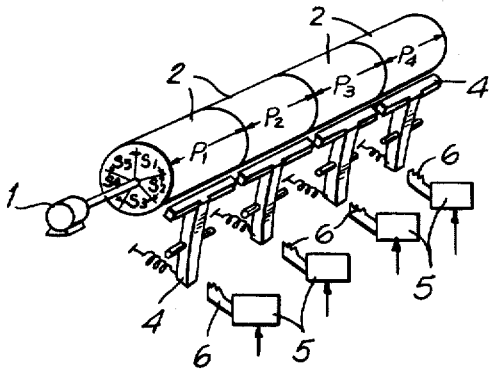
FIG. 1 PRIOR ART
FIG. 1 is a top perspective view of an impact-type drum printer of the prior art wherein each hammer prints a plurality of columns.
Figure 2:
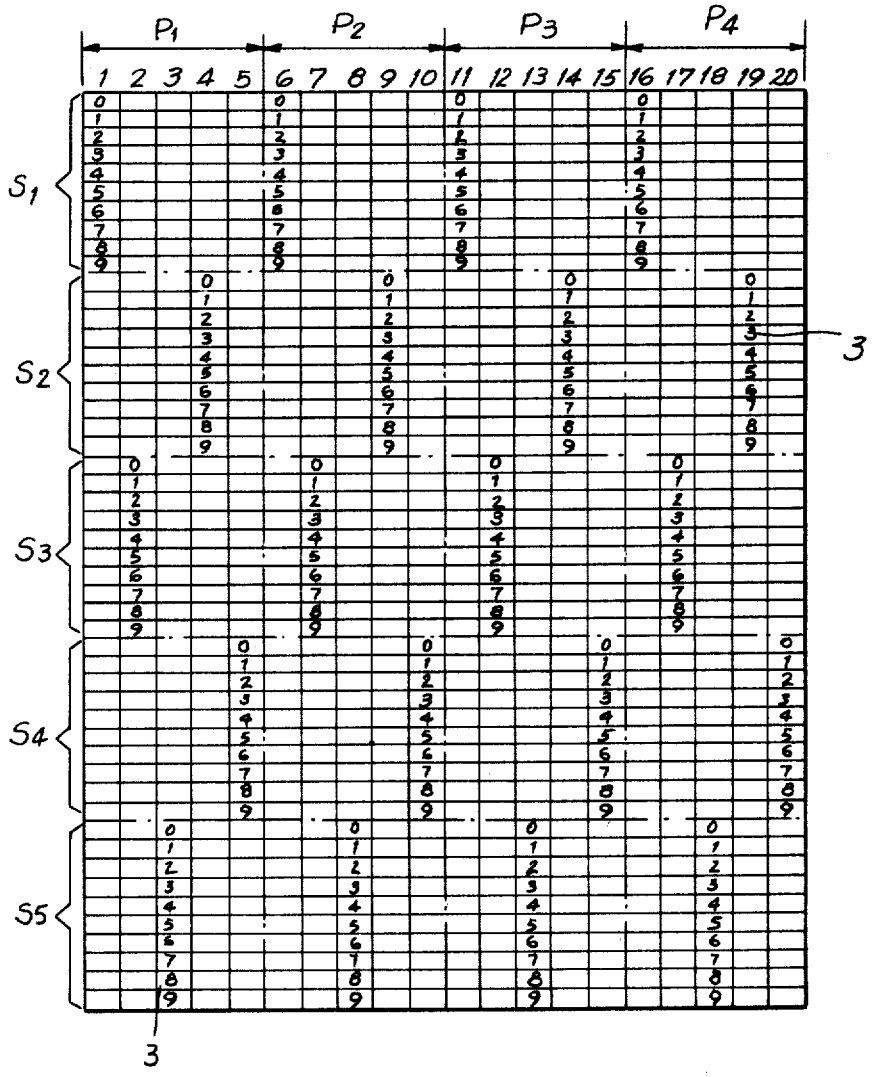
FIG. 2 PRIOR ART
FIG. 2 is a planar development view showing character locations on the character drums in the printer of FIG. 1.

FIG. 1 shows a flying type drum printer of the prior art wherein characters for five columns are printed using the same hammer 4 and the same character drum 2. There are four character drums and four hammers whereby a line of twenty characters can be printed. On the outer peripheral surface of each character drum 2, raised characters 3 (FIG. 2) are provided, for example, letters, numerals, symbols, etc., for printing five columns. FIG. 2 shows the arrangement of the characters on the four character drums 2 in relation to each other as it would be seen if the circumferential surface of the drums were unrolled and laid-out flat. Each character drum 2 is divided radially into five segments $S_1$ through $S_5$, and within each segment are located the characters 3 for printing only one column. In the first segments, $S_1$, the first column of each character ring 2, that is, in FIG. 2, columns 1, 6, 11 and 16, contains the raised characters 0-9. The other columns in the segments $S_1$ are devoid of raised characters 3. Each segment includes one column of raised characters, all in the same relative position on the character drums 2.

Using this structure, four hammers are needed for printing twenty columns, and only four electric coils 6 and four driving circuits 5 for independently driving the hammers 4 are sufficient. However, a drum printer, as shown in FIG. 1, is generally not suitable for use in an office or other quiet place because the knocking sound made by the hammers 4 is loud and the printer generally speaking is noisy. Further, with regard to the arrangement of characters 3 on the character drums 2, the diameter of the character drums is of necessity large so as to accommodate the five segments S. Therefore, it is difficult to miniaturize the printer of FIG. 1 and the energy required to drive the motor 1 is high as compared to a miniaturized printer.

Figure 3:
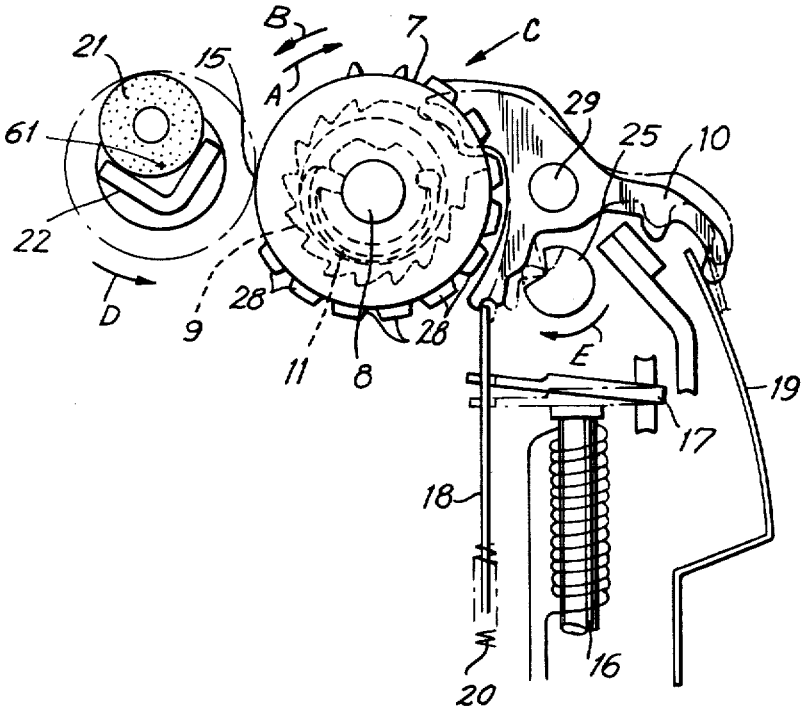
FIG. 3 PRIOR ART
FIG. 3 is a side elevational view of a character selecting and printing mechanism of a character ring-selecting type printer of the prior art.
Figure 4:
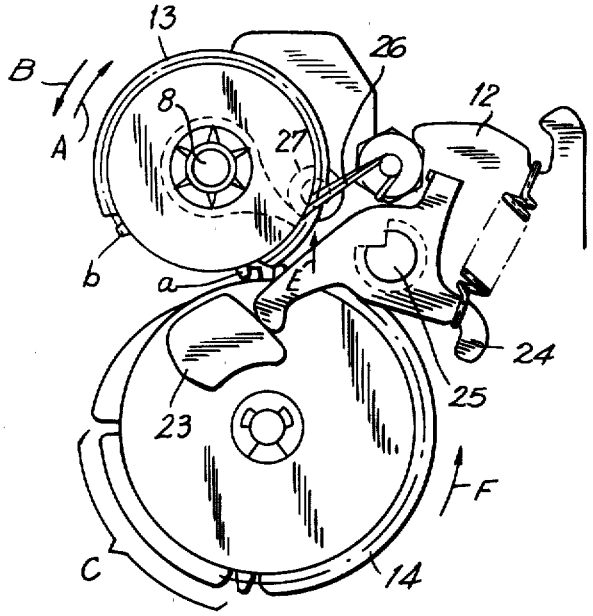
FIG. 4 PRIOR ART
FIG. 4 is a side elevational view of the drive mechanism for the character rings of FIG. 3.
Figure 5:
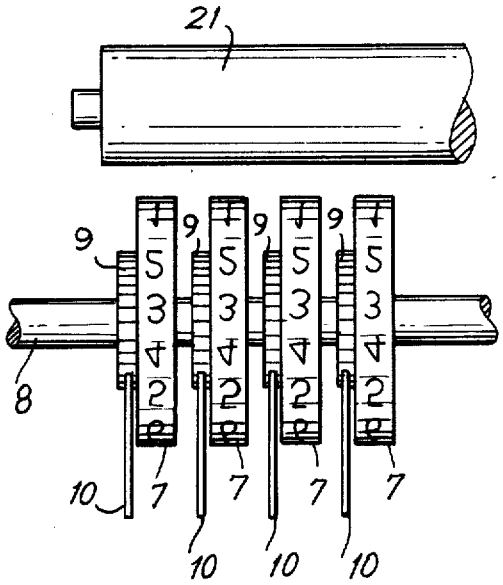
FIG. 5 PRIOR ART
FIG. 5 is a partial top view of the printing mechanism of FIG. 3.

Another conventional character ring selecting type printer of the prior art is shown in FIGS. 3, 4 and 5. FIG. 3 shows a cross-sectional side view of a printing mechanism and FIG. 4 shows a gear train for driving the printing operations and the major elements used to restore the mechanism to a stand-by condition after the printing is completed. FIG. 5 is a plan view of a portion of this printer showing the relationship between character rings 7. Each character ring is mounted on a drive shaft 8 and each character ring 7 contains one character column on its periphery. Thus, each column of print is produced by an independent character ring 7. This is in contrast with the character drums 2 of FIG. 1 wherein a single drum accounts for the printing of a plurality of adjacent columns.

The outer peripheral surface of each character ring 7 is divided into sixteen circumferential segments and twelve of these segments are devoted to raised characters 28 and four segments are blank, that is, not raised from the character ring 7. A ratchet wheel 9 is positioned on one side of each character ring 7. The ratchet wheel 9 has teeth corresponding in circumferential spacing to the twelve characters 28, and a selecting pawl 10 is positioned for engagement with each ratchet wheel 9. Inside each character ring 7, one end of a spring 11 engages in a V-groove in the drive shaft 8, the other end engaging the character ring 7 so as to hold the character rings 7 and the drive shaft 8 together as a unitary structure for rotation, as described more fully hereinafter.

In the process of selecting characters 28 for printing, each character ring 7 rotates simultaneously with the shaft 8 until selective actuation of each of the pawls 10 causes the pawls 10 to engage the associated ratchet wheels 9 and stop rotation of the associated character rings 7 when the selected character 28 is in the printing position 15. Although rotation of the ratchet wheel 9 and character ring 7 is stopped when the pawl 10 engages a tooth of the ratchet wheel 9, the drive shaft 8 continues to rotate. The spring 11 is driven out of the V-groove in the shaft 8 leaving the character ring 7 at its selected position. It should be understood that each character ring 7 is associated with an individual pawl member 10, ratchet wheel 9, inner spring 11, etc., and operates in a similar manner.

A selection gear 13 (FIG. 4) is connected to the drive shaft 8 and mounted on a frame member 12. The selection gear 13 is toothed only around a portion of its periphery and with these teeth engages an intermittent gear 14 to rotate the drive shaft 8 and the character rings 7 in the direction indicated by the arrow A. A spring 26 engages the outer periphery of the selection gear 13 and is used for restoring the character ring and drive shaft 8 after printing is completed. The spring 26 returns the shaft 8 and character ring 7 to the stand-by position where they were located before character selection procedures were initiated.

When an instruction for printing is given by control means (not shown), a motor (not shown) rotates the intermittent gear 14 in the direction indicated by the arrow F by means of a gear train (not shown). When the first tooth of the intermittent gear 14 becomes engaged with the first tooth a of the selection gear 13, the drive shaft 8 rotates with the character rings in the direction of the arrow A. In this process, the spring 26 for restoring the character ring 7 to a standby position, is wound up. Then the character selecting process begins and it is carried out as described above with each pawl 10 engaging the associated ratchet wheel 9 when the associated character ring 7 presents the proper character 28 at the printing position 15.

Before the character 28 which is to be printed, comes to the printing position 15, that is, on a straight line which connects the center of the drive shaft 8 with the rotational center 61 of a platen roller 21, an electric current is passed through an electric magnet 16 associated with the character ring 7 bearing the character 28 selected for printing. By energizing the electromagnet 16, an attraction plate 17 is drawn to the magnet 16, as indicated by the broken lines in FIG. 3, and a connected trigger bar 18 is drawn so as to disengage from the selection pawl 10.

The selection pawl 10 is biased by the force of a selection spring 19 and is always primed for rotation in a direction indicated by the arrow C. The pawl 10 instantly pivots about the axis 29 when released by the bar 18 and in so doing engages with a tooth of the ratchet wheel 9 corresponding to the character that has been selected for printing. The pawl 10 stops that particular associated character ring from further rotation with the shaft 8. When the trigger electromagnet 16 is de-energized, the trigger bar 18 is pushed upward by the restoring force of a trigger bar spring 20 which was compressed by the prior motion of the attraction plate 17. However, the selection pawl 10 remains in its pivoted position (broken lines, FIG. 3) engaged with the ratchet wheel 9. Therefore, the trigger bar 18 cannot return to its initial position.

Because the character ring 7 is held by the selection pawl 10 and ratchet 9, as the drive shaft 8 continues to rotate, the spring 11 is forced up from the V-groove of the drive shaft 8, as previously described, and rides on the periphery of the shaft 8. The drive shaft 8 comes to a stand-still when the last tooth b of the selection gear 13 abuts an untoothed sliding face c of the intermittent gear 14. At this time, the character 28 on the character ring 7 that is to be printed is located at the printing position 15. When no character 28 on a ring 7 is selected, a blank portion of the ring 7 is present at the printing position 15.

A crank 22 supporting the platen roller 21 for eccentric motion about a center of rotation 61 is then rotated in the direction of the arrow D by means of a gear train from the motor (not shown). The roller 21 also can rotate about its own longitudinal axis. When the character rings 7 come to the stop position and the characters 28 that are to be printed are all present at the printing position 15, the platen roller 21 is also approaching the printing position 15. When the crank 22 is further rotated, the platen roller rolls and presses a recording paper (not shown) against the selected character 28 through a ribbon (not shown) in the known manner. The paper and ribbon are located between the platen 21 and the characters 28.

Substantially at the moment printing is completed, a reset lever 24 and a reset lever shaft 25 to which the reset lever 24 is rigidly attached, are rotated in the direction of the arrow E by a cam 23 positioned on a side surface of the intermittent gear 14. The selection pawl 10 contacting the reset lever shaft 25 rotates in the direction opposite of the arrow C and releases from the ratchet wheel 9 of the character ring 7. At this moment, and for the first time, the trigger bar 18 is able to return to its initial position in engagement with the selection pawl 10. While the characters 28 are printed, intermittent gear 14 continues to rotate. At the moment that the printing is completed, contact of the last tooth b on the selection gear 13 with the untoothed sliding face c of the intermittent gear 14 is broken. Then, the character ring 7 rotates in the direction of the arrow B impelled by the restoring force of the spring 26. Simultaneously, the end of the spring 11 falls back into the V-groove on the drive shaft 8, and the character ring 7 and shaft 8 are again joined as an integral structure for rotation together. The selection gear 13, on the same drive shaft 8 as the character ring 7, strikes against a stop 27 positioned on the frame 12 whereby the character rings 7 stop at the standby position ready for the selection of the next character. Thus, the character ring return operation has been described.

A printer with the structure as shown in FIGS. 3, 4 and 5 has an advantage in that the noise emitted at the time of printing is of low level because the characters are printed by a roller 21 pressed against a character group which has been brought to rest. However, as shown in FIG. 5, the character ring rings 7 are close to each other. Further, a ratchet wheel 9 and the associated springs and pawl 10 are positioned between each character ring 7. Such a printer design has the disadvantage that the action becomes sluggish and erratic when the manufacturing accuracy of each part varies as it always will to some degree.

A printer, in accordance with this invention, is designed with recognition of the above-described advantages and deficiencies. The printer in accordance with this invention includes the best feature, that is, quiet printing, which is found in a conventional printer of the type shown in FIGS. 3, 4 and 5. Thus, the printer in accordance with this invention is not only usable in an office, in quiet surroundings, and the like, but also it is miniaturized and can be applied to a personal electronic calculator operated by an individual. Because the number of critically dimensioned parts is less and these parts are spaced further apart, the printer of this invention is more economical to produce and more reliable in operation.

Figure 6:
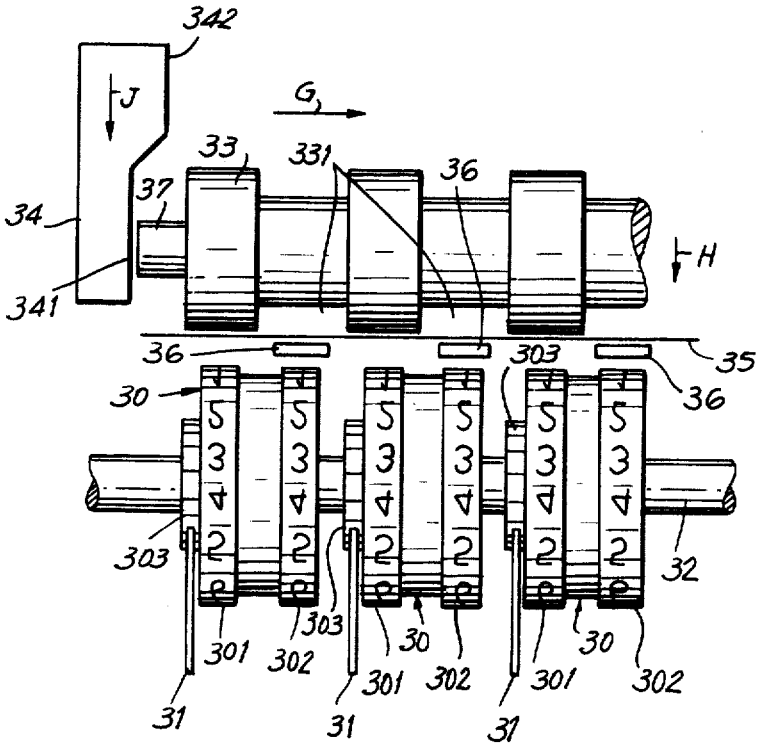
FIG. 6 is a top view, similar to FIG. 5, showing the character ring, platen and selection mechanism of a character ring selecting type printer in accordance with this invention.

FIG. 6 is a plan view of a miniature printer in accordance with this invention. A plurality of print rings 30, are positioned on a drive shaft 32. Two character columns 301, 302, are positioned circumferentially around the print ring 30. It should be understood that all of the print rings are similarly constructed. The character columns include the raised characters representing numerals, symbols, and the like as described above with reference to the prior art printer of FIGS. 3–5. A single ratchet wheel 303 is attached to the side of each print ring 30 with the teeth of the ratchet wheel 303 corresponding to the positions of the characters on the peripheral circular surface of the character ring 30. The ratchet wheel 303 engages with a selection pawl 31. A platen 33 faces the assemblage of character rings and includes recessed portions 331. The recessed portions 331 are positioned so that when the platen 33 advances in the direction indicated by the arrow H, as explained more fully hereinafter, the recessed portions are in registry with one of the character columns on each print ring 30. As seen in FIG. 6, the non-recessed portions of the platen 33 are positioned so as to press against a character on the other character column of each print ring 30. As seen in FIG. 6, the left-most character columns 301 on each print ring 30 will be contacted by the unrecessed portions of the platen 33 when the platen advances in the direction indicated by the arrow H.

A cam 34 engages one end of a shaft 37 to which the platen 33 is mounted. When the cam 34 is advanced (by means not shown) in the direction indicated by the arrow J, the shaft 37 and platen 33 are moved in the direction indicated by the arrow G. The platen 33 moves in the direction G against the force of a spring (not shown) which causes the platen 33 to return to the position shown in FIG. 6 when the cam 34 is moved in the direction opposite to that indicated in the arrow J.

In order to print a character with the construction of FIG. 6 in accordance with this invention, a desired character in the left character column 301 on the character ring 30 is stopped at the printing position opposite to the platen by actuation of the selection pawl 31 by means of an electromagnet and mechanism (not shown). After the same selection process is completed on all of the character rings 30, the platen 33 is translated in the direction of arrow H and pressed against the selected characters of the character ring 30 through the recording paper 35. The desired characters are printed on the recording paper 35 because ink is distributed on the character ring 30 prior to printing by an ink roller (not shown) in the conventional manner. At this time, the platen 33 has its non-recessed portions facing only the left character columns 301 of the character rings 30 and no character in the right character columns 302 is pressed against or printed. Accordingly, characters are printed on the paper at intervals of two columns or spaces along a printed line.

After the characters are printed, all components are returned to the initial standby condition. In order to print characters for all of the columns, the cam 34 is translated in the direction indicated by the arrow J until the portion 342 of the cam 34 presses against the shaft 37 and causes the platen 33 to translate in the direction indicated by the arrow G. The offset surface 342 of the cam 34 drives the platen 33 such that the unrecessed portions are in registry with the right-hand character columns 302 on the print rings 30. In this condition, the desired characters in the right-hand character columns 302 are selected by stopping the character rings 30 at the printing position by means of the selection pawl 31 and electromagnet (not shown). With the character rings 30 stopped, the platen 33 is moved in the direction of the arrow H once more so as to press against the selected characters in the right-hand character columns 302 on the character rings 30. Thus, a desired character is printed in the portion of the printed line which was left blank by the previous step of printing. Thus, printing of all columns is completed. In the embodiment shown in FIG. 6, a printed line having six characters or columns, evenly spaced, would be produced.

It should be understood with respect to the embodiment in accordance with this invention (FIG. 6), that the platen is advanced to the characters in a rolling motion and characters are selected by means of the pawls 31, etc., in the same manner as described with respect to the prior art embodiment of FIGS. 3–5. The return of the print rings to their standby position and advance to the printing position are accomplished by mechanisms similar to those associated with the embodiment of FIGS. 3–5. Accordingly, these mechanisms are not recited again in this description of the printer in accordance with this invention of FIG. 6.

There is a possibility that a character in a character column which is not being printed will touch the paper 35 at the time of printing of characters in the adjacent character column. In other words, when printing a character from the character column 301, it is possible that the same character in the character column 302 will make contact inadvertently with the paper 35 as the platen advances in the direction H to press against the character of column 301. A similar problem occurs when the platen 33 has shifted to print the remaining characters. Such unintended contact between the characters and the printing paper 35 can stain or mar the paper. However, the staining of the paper is prevented by means of a mask 36 located in registry with each recessed portion of the platen 33 and positioned between the non-printing character columns and the paper 35. In this way, the non-printing characters press against a surface of the mask 36 and are prevented from making unintentional contact with the paper 35 during the printing operation of characters in adjacent columns. The mask 36 moves with the platen 33 as it translates in the direction G (and return) such that the mask is always in position in registry with the recessed portions 331 of the platen 33.

It should be understood that in alternative embodiments in accordance with this invention, the print rings 30 can include more than two character columns which are illustrated in FIG. 6. Operating principles are similar and the cam 34 has n-1 steps when there are n character columns on a single print ring 30. Each character column on each print ring is printed separately from the other character columns on the same print ring, but one character column is printed simultaneously with one character column of every other print ring. The recessed portions in the platen 33 are sufficiently wide such that there is no pressure on the characters in the columns which are not being printed.

In such printers, for example, in FIG. 6, lateral space for two columns can be used for the character ring selecting mechanism and the adjacent columns are not close to each other. The efficiency of the printer is improved by extending the space available for the electromagnet. Also, the number of parts is reduced and the number of assembly steps are reduced by selecting characters for two printed columns by means of one selection pawl and electromagnet, etc. The embodiment of FIG. 6, in accordance with this invention, reduces by half the number of parts which are complex and must be fabricated with high precision, and provides a structure having sufficient space and accessibility. As a result, an inexpensive and reliable printer is obtained. The printer in accordance with this invention overcomes the deficiencies of conventional printers, such as noise, without losing the advantages of small size.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A character ring selecting type printer for printing on a print media, comprising:

a plurality of character rings mounted for rotation, each said character ring having at least two character columns on the periphery thereof, said columns being laterally separated;

means for rotating said character rings;

individual means for stopping each said character ring in any selected rotational position;

pressing means for simultaneously pressing against each said character ring for printing while said character rings are stopped, said pressing means always operating simultaneously, when pressing, said pressing means pressing only a first one of said at least two character columns on each said character ring at any one time;

means for laterally translating said pressing means from a position in which each pressing means is positioned adjacent one character column on a character ring to a position in which each pressing means is adjacent another character column of the same character ring, said translated pressing means when pressing, always simultaneously pressing for printing only said another one of said at least two character columns on each said character ring.

2. A character ring selecting type printer as claimed in claim 1, wherein said pressing means is a platen, the surface of said platen including recessed and non-recessed portions, said non-recessed portions being in registry with one character column for printing on each of said character rings, the other character columns being in registry with said recessed portions, whereby printing is produced simultaneously by a portion of said character rings in registry with said non-recessed portions of said platen.

3. A character ring printer as claimed in claim 2, wherein said recessed and non-recessed portions are alternately and laterally spaced along said platen.

4. A character ring printer as claimed in claim 2, wherein said means for translating includes a cam connected to said platen, said cam being contoured to stop said platen at lateral positions whereby said non-recessed portions register individually with each of said at least two character columns.

5. A character ring printer as claimed in claim 4, wherein said means for stopping, includes an individual ratchet wheel mounted for rotation with each said character ring, and pawl means for engaging said ratchet wheel at said selected rotational position.

6. A character ring printer as claimed in claim 1 or 5, and further comprising a mask, said print media being positioned between said pressing means and said character rings, said mask being in registry with said recessed portions of said pressing means and positioned between said print media and said print rings, whereby said print media is protected from inadvertent stains from said print rings.

7. A character ring printer as claimed in claim 6, wherein said mask translates in unison with said means for translating said pressing means.

8. A character ring printer as claimed in claim 1 or 5, wherein the number of said character rings is M, the number of said character columns on each said character ring is N, and said pressing means simultaneously presses M character columns, said simultaneously pressed character columns being N intervals apart, and said means for translating moves said pressing means N times whereby $N \times M$ laterally spaced columns can be printed on said print media.

9. A character ring printer as claimed in claim 7, wherein the number of said character rings is M, the number of said character columns on each said character ring is N, and said pressing means simultaneously presses M character columns, said simultaneously pressed character columns being N intervals apart, and said means for translating moves said pressing means N times whereby N×M laterally spaced columns can be printed on said print media.

* * * * *